United States Patent [19]

Sohtome et al.

[11] Patent Number: 4,949,609

[45] Date of Patent: Aug. 21, 1990

[54] CUTTING APPRATUS FOR TOWEL CLOTH

[75] Inventors: Kenichi Sohtome, Tochigi; Munetaka Nagasaki, Osaka, both of Japan

[73] Assignee: SSMC Inc., Edison, N.J.

[21] Appl. No.: 361,533

[22] Filed: Jun. 5, 1989

[30] Foreign Application Priority Data

Jul. 11, 1988 [JP] Japan ..... 63-171022

[51] Int. Cl.[5] ..... B26D 7/00

[52] U.S. Cl. ..... 83/175; 83/251; 83/277; 83/418

[58] Field of Search ..... 83/206, 262, 268, 277, 83/282, 371, 368, 175, 418, 419

[56] References Cited

U.S. PATENT DOCUMENTS

| | | | |
|---|---|---|---|
| 3,496,811 | 2/1970 | Flanagan et al. | 83/277 |
| 3,823,629 | 7/1974 | Bleimund | 83/419 |
| 4,034,634 | 7/1977 | Arbter | 83/282 |
| 4,212,213 | 7/1980 | Wolfelsperger et al. | 83/418 |
| 4,781,087 | 11/1988 | Shibata | 83/368 |

*Primary Examiner*—Hien H. Phan
*Assistant Examiner*—Hwei-sui Payer
*Attorney, Agent, or Firm*—Theodore Jay

[57] ABSTRACT

A piece of towel material is separate from a long sized towel cloth by cutting off margin portions composed of only warp yarn spaced in a predetermined interval. A plurality of comb teeth are fixedly mounted on a comb tooth fixing shaft. Each comb tooth comprises a base portion and an operative portion formed in L-shaped. the operative portion has a width corresponding to a longitudinal width of the warp yarn of the towel cloth. The comb tooth fixing shaft is positioned under the towel cloth across the longitudinal direction of the towel cloth. The comb tooth fixing shaft is rotated to permit the operative portion of the comb tooth to engage the surface of the towel cloth.

3 Claims, 6 Drawing Sheets

CUTTING APPRATUS FOR TOWEL CLOTH

BACKGROUND OF THE INVENTION

1. Field of the Invention:

The present invention relates to a cutting apparatus for towel cloth for correcting bent portions of a long sized towel cloth having portions composed of only warp yarns and having no weft yarns (hereafter referred to as margin portions) extended in the longitudinal direction thereof spaced in a predetermined interval, and, thereafter, cutting off the long sized towel cloth to prepare a piece of material.

2. Description of Prior Art:

A prior art cutting apparatus of this type comprises a plurality of comb teeth fixed to a working table and crossing the long sized towel cloth, each comb tooth being engaged with a margin portion, and a cutter means positioned adjacet to the comb teeth for cutting off a center portion of the margin portion.

However, a vertically movable cutter is disposed at the location separated in a predetermined interval from the comb teeth so that the cutter means do not interfere with a series of comb teeth. As a result, the margin portion not essential to the towel cloth, could not be reduced or shortened.

SUMMARY OF THE INVENTION

The present invention overcomes the problems of the prior art cutting apparatus.

It is therefore an object of the present invention to provide a cutting apparatus for a towel cloth capable of cutting the margin portion of the towel cloth at the substantially central portion thereof without hindering the operation of a correction piece.

To achieve the above object, a cutting apparatus for a towel cloth comprises a body of a sewing machine having working tables. The working tables have a space therebetween. A clamping unit is provided at a working table for clamping the end of the towel cloth having margin portins. A towel drawing unit is provided for drawing a piece of towel from the towel cloth. A towel alignment portion is rotatably supported by a bracket fixed to the body of the sewing machine. A cutting device is positioned adjacent to the towel alignment portion. The towel cloth alignment unit comprises a segment gear fixed to the end thereof; a comb teeth fixing shaft fixed to the segment gear and arranged across the longitudinal direction of the towel cloth; a plurality of comb teeth each composed of a base portion and an operative portion forming an L-shape and arranged in series and fixed to the fixing shaft via spacers intervened between each comb tooth; a pinion engaged with the segment gear for normally or reversely rotating the segment, and a motor for normally or reversely rotating the comb teeth fixing shaft. When the segment is reversely rotated, the operative portion of the comb teeth is engageable with a length of the warp yarn of the margin portion.

The above and other objects, features and advantages of the present invention will become more apparent from the following description taken in conjunction with the accompanying drawings.

DESCRIPTION OF THE PREFERRED EMBODIMENT

Figure 1:
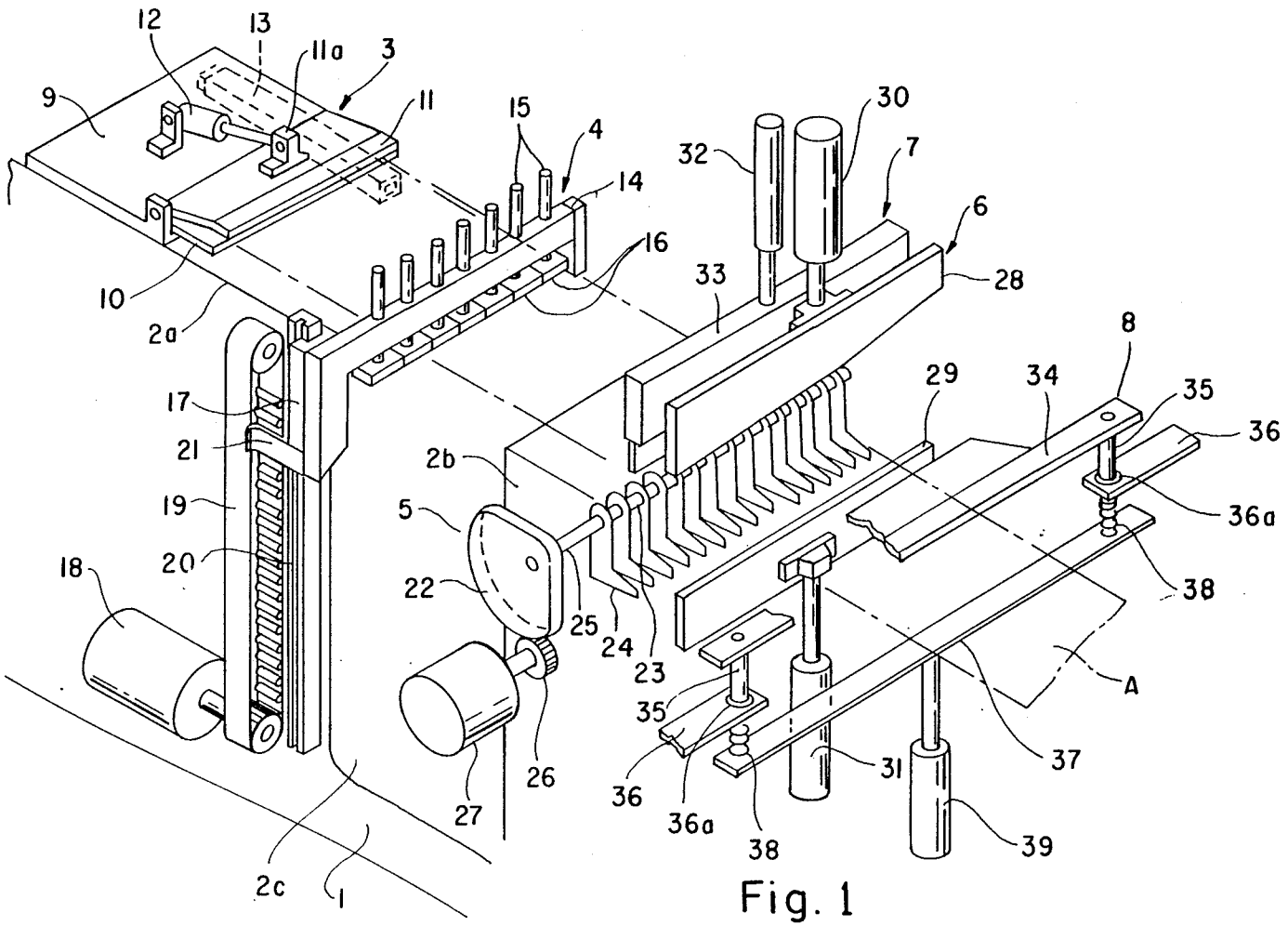
FIG. 1 is a perspective partially fragementary view of a cutting apparatus for a towel cloth according to an embodiment of the present invention.

A preferred embodiment of the present invention will be hereinafter described with reference to FIGS. 1 to 2.

A long sized towel cloth A, to be cut off by the cutting device according to the present invention, has margin portions 1A in a predetermined interval.

The cutting apparatus for a towel cloth comprises a towel automtic sewing machine (hereafter referred to as only a body 1), with working tables 2*a*, 2*b* respectively provided at the body 1 and opposed each other with a space 2*c* defined therebetween. A clamping unit 3 is provided at the working table 2*a* for clamping the end of the towel cloth A. A towel drawing unit 4 is also provided at the working table 2*a* for drawing a piece of the towel from the towel cloth A. A towel alignment unit 5 is provided at the working table 2*b*. A cutting device 6 is positioned adjacent to the towel alignment unit 5. A front pressing unit 7 is positioned adjacent to the cutting device 6 for pressing the front portion of the towel cloth A at the time of cutting off the towel cloth A. A rear pressing unit 8 is provided at the working table 2*b* for pressing the rear portion of the towel cloth A at the time of cutting off the towel cloth A.

Each constituent of the cutting apparatus will be described more in detail.

The clamping unit 3 includes a base plate 9 slidable on the first table 2*a* in the longitudinal direction of the towel cloth A toward the second table 2*b*. A fixed metal piece 10 projects from an inner end of the base plate 9. A movable metal piece 11 is disposed opposite the fixed metal 10 and is swingably pivotally supported by a bracket on the base plate 9. A pneumatic cylinder 12 has a piston rod for actuating the movable metal piece 11. The pneumatic cylinder 12 is swingably mounted on a bracket on the base plate 9 at the end thereof. The tip end of the piston rod is pivotally mounted on an attached member 11*a* fixed to the movable metal piece 11. The pneumatic cylinder unit 12 is actuated forwardly, namely, to permit the movable metal piece 11 to move toward the fixed metal piece 10 so that the towel cloth A positioned between the movable metal piece 11 and the fixed metal piece 10 is held between the movable metal piece 11 and the fixed metal piece 10. The pneumatic cylinder unit 12 is actuated rearwardly, namely to permit the movable metal piece 11 to move away from the fixed metal piece 10 to release the clamping of the towel cloth A.

A movable means 13 for moving the clamping unit 3 has a movable part fixed to the lower surface of the base plate 9 and a fixed part fixed to the body of the sewing body 1 when the movable means 13 is a known pneumatic cylinder. The movable means 13 may be composed of a rack fixed to the base plate 9 and a pinion fixed to the body 1.

The towel cloth drawing unit 4 includes a body 14 of an L-shaped bar extending across the towel cloth A transversely to the longitudinal direction thereof. Each of a plurality of pneumatic cylinders 15 has a piston penetrating the L-shaped body 14 and arranged to be spaced in a predetermined interval. A plurality of correction pieces 16 are each secured to an end of the piston rod without interferring with each other for contacting and pressing the surface of the towel cloth. A bracket 17 is secured to an end of the L-shaped body 14 and has a belt clip 21 secured to the bracket 17 engaged with a timing belt 19 which is driven by a drive motor 18 provided at a side of the sewing body 1. A guide rail 20 is disposed in parallel with the timing belt 19 for guiding the bracket 17. The L-shaped body 14 is moved upward by the drive motor 18 for permitting the clamping unit 3 to pass between the L-shaped body 14 and the towel cloth A. The L-shaped body 14 is vertically moved by normal and reverse driving of the drive motor 18. Each piston rod is actuated by supplying air under pressure to the pneumatic cylinders 15 so that each correction piece 16 presses the upper surface of the towel cloth A and draws the towel cloth affected individually by the correction piece 16.

The towel cloth alignment portionn 5 rotatably supported by a bracket (not shown) fixed to the body 1 includes a segment gear 22 secured to the end thereof. A comb teeth supporting shaft 25 is secured to the segment gear 22 and is arranged across the longitudinal direction of the towel cloth A. A plurality of comb teeth 24 are arranged in series and are secured to the shaft 25 via spacers 23 disposed between each comb tooth 24. A pinion 26 is engaged with the segment gear 22 for normally or reversely rotating the segment 22 with power from a motor 24 secured to the body 1 via a supporter (not shown).

Figure 2:
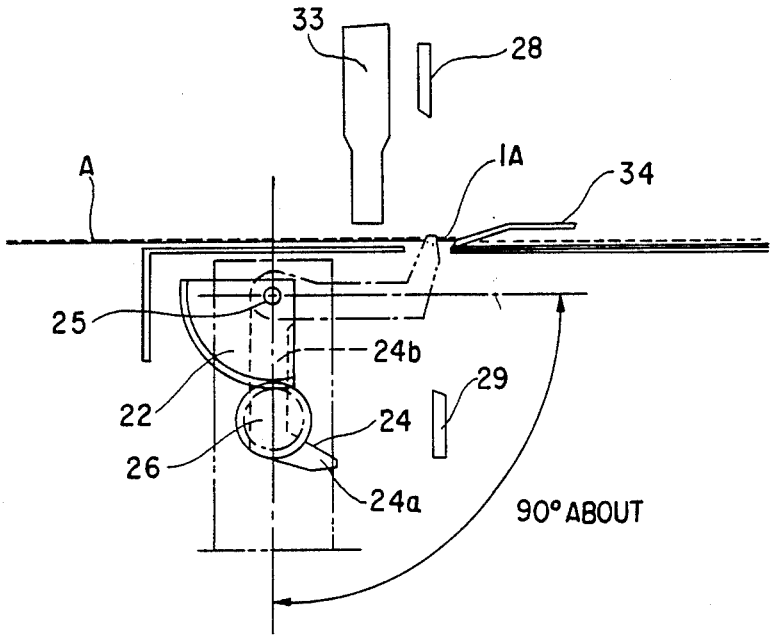
FIG.2 is an enlarged view of a main portion of a towel cloth alignment unit of the cutting apparatus for a towel cloth according to the embodiment of the present invention.
Figure 3A:
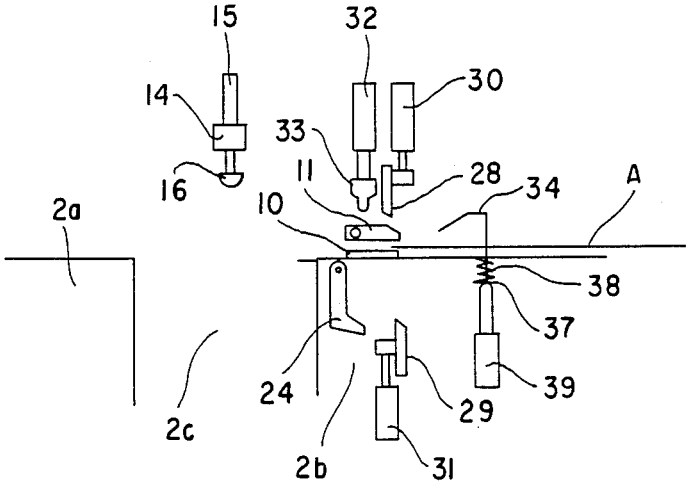
FIGS. 3(*a*), 3(*b*), 3(*c*), 3(*d*), 3(*e*), 3(*f*), 3(*g*), 3(*h*) are views illustrating different sequential steps in operating the cutting apparatus for a towel cloth according to an embodiment of the present invention.
Figure 3B:
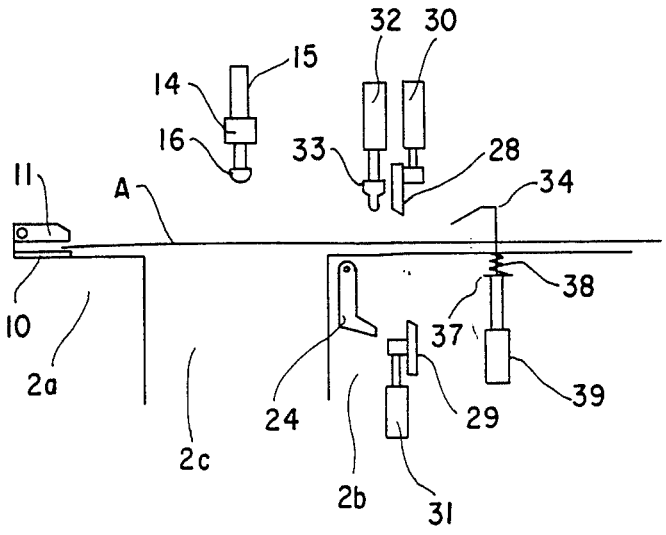
Figure 3C:
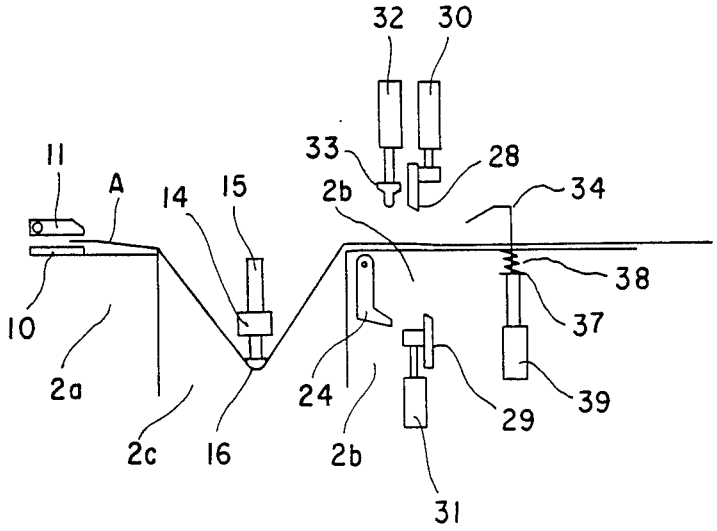
Figure 3D:
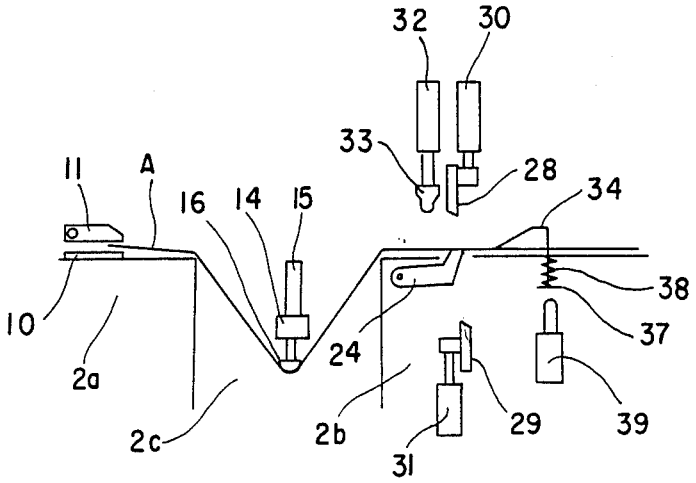
Figure 3E:
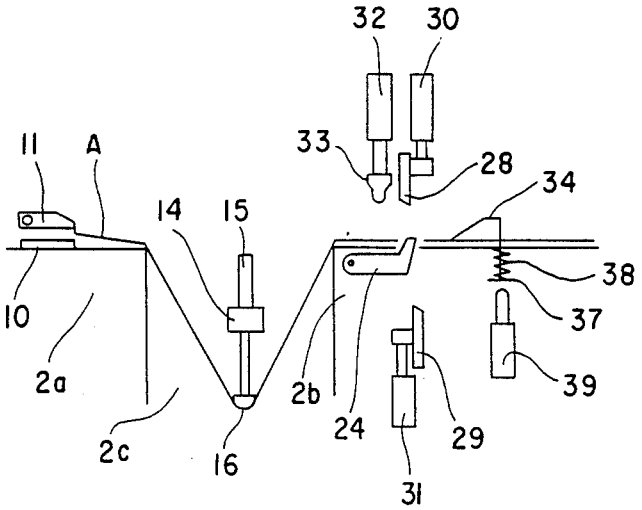
Figure 3F:
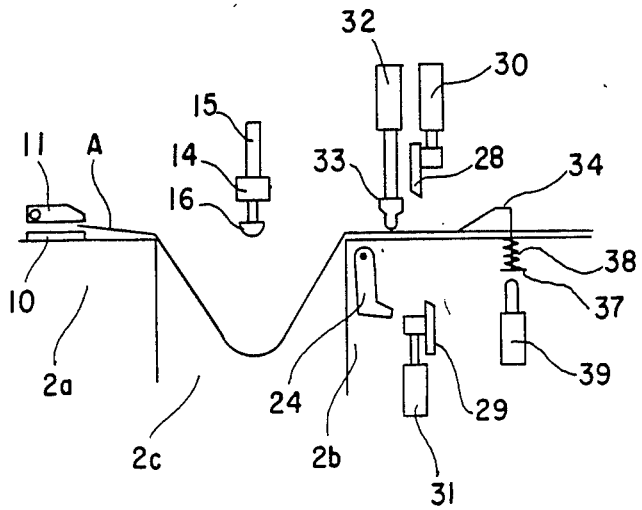
Figure 3G:
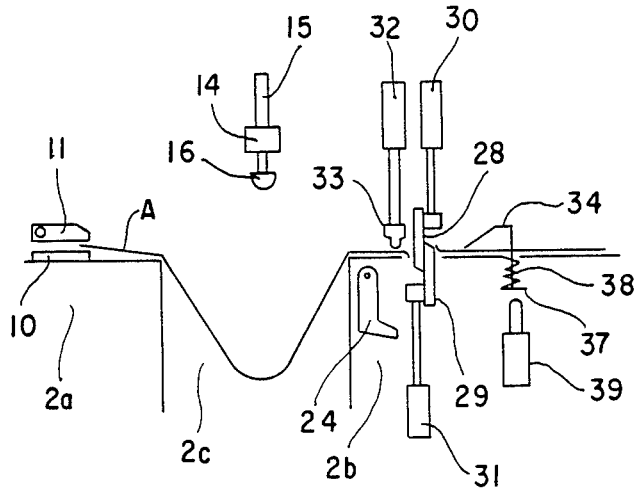
Figure 3H:
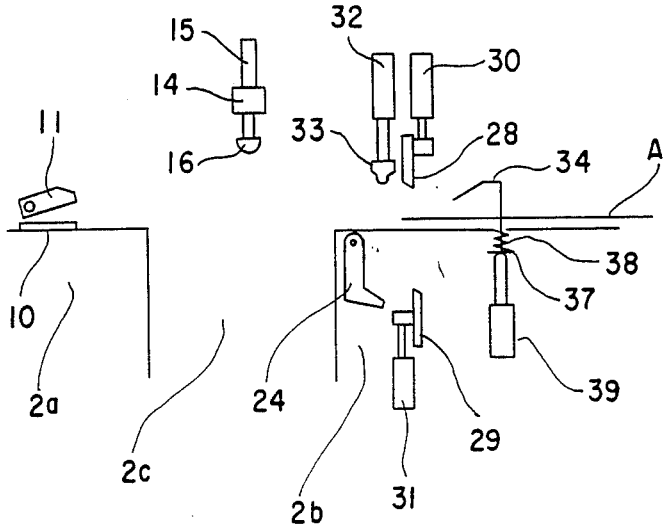
Figure 4:
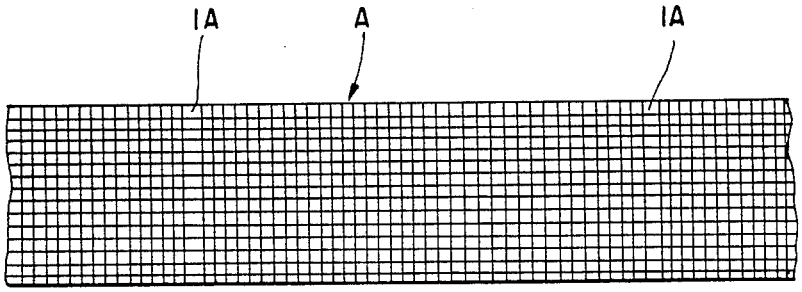
FIG. 4 is a view showing a towel cloth.

The segment gear 22 has a rotative angle of 90 degrees as shown in FIG. 2. The comb teeth has a base portion **24*b* and an operative portion 24*a* forming an L-shape. The operative portions 24*a* has a width engageable with a length of the warp yarn 1A while the base portion 24*b* is penetrated by and fixed to the comb fixing shaft 25. When the segment gear 22 is turned clockwise or counterclockwise the operative poriton 24*a*** positioned in a lower position or a rising position.

The towel cutting device 6 includes upper and lower cutters 28, 29 opposed to each other across the longitudinal direction of the towel cloth A. A pneumatic cylinder 30 is secured to the body 1 for securing the upper cutter 28 at the tip end of a piston rod thereof. A pneumatic cylinder 31 is secured to the body 1 for securing the lower cutter 29 at the tip end of a piston rod thereof. The towel cloth A can be cut off by both the cutters 28, 29 with actuation of the pneumatic cylinders 30, 31.

The front pressing unit 7 positioned adjacent to the towel cutting device 6 at the side of the towel drawing unit 4 includes a bar-shaped pressing member 33, and a pneumatic cylinder 32 secured to the body 1 via a supporter (not shown) for securing the bar-shaped pressing member 38 at the tip end of a piston rod thereof. Accordingly, when the towel cloth A is cut off by the towel cutting device 6 the penumatic cylinder 32 is actuated to move forwardly for permitting the pressing member 33 to press the towel cloth A toward the working table **2*b***.

The rear pressing unit 8 includes a bar-shaped pressing plate 34 having an overhanging edge and positioned in parallel with the pressing member 33 for clamping the towel cutting device 6 with the aid of the front pressing unit 7. The pressing plate 34 is secured at both ends thereof to upper ends of the guide rods 35, 35 fixed to a support plate 37 at the lower ends thereof by penetrating bushes **36*a*, 36*a* of the brackets 36, 36 fixed to both sides of the body 1. Coil springs 38, 38 are provided between the support plate 37 and both the brackets 36, 36 for permitting the pressing plate 34 to downwardly urge to press the upper surface of the towel cloth A so that the towel cloth A contacts the upper surface of the working table 2*b*. A pneumatic cylinder 39 is secured at one end to the support 37 at a piston rod thereof and at the other end to a support member (not shown) of the body 1 for raising the pressing plate 34 by the forward movement of the piston thereof whereby the coil springs 38, 38 are compressed so that the towel cloth A can be released from being pressed by the pressing plate 34**.

The operation of the cutting apparatus for the towel cloth according to the embodiment of the present invention will be now described hereinafter with reference to FIGS. 3(*a*) to 3(*f*).

In FIG. 3(*a*), the L-shaped body 14 of the towel drawing unit 4 is placed in an upper position by the reverse driving (counterclockwise direction) of the drive motor 18.

The upper cutter 28 is in an upper position and the lower cutter 29 is in a lower position by the backward movements of the piston of both pneumatic cylinders 30, 31.

The drive motor 27 of th towel alignment unit 5 is reversely rotated to thereby rotate clockwise the segment gear 22, so that each comb tooth 24 is in a lower position.

The pressing member 33 is placed in an upper position by the backward movement of the piston of the pneumatic cylinder 32 of the front pressing unit 7.

The pressing member 34 is in an upper position by the forward movement of the piston of the pneumatic cylinder 39 of the rear pressing unit 8.

At the state set forth above, the clamping unit 3 is moved into the opening defined between the upper cutter 28 and the lower cutter 29, while the towel cloth A is clamped by the movable metal plate 11 and the fixed metal plate 10 by the forward movement of the movable means 13.

At the state in FIG. 3(*b*), the clamping unit 3 is moved backward by the backward movement of the movable means 13 so that the towel cloth A is drawn to a predetermined position by the fixed and the movable metal pieces 10, 11.

At the state in FIG. 3(*c*), the L-shaped body 14 is lowered by the normal rotation of the drive motor 18 of the towel cloth drawing unit 4 to press the towel cloth A downwardly toward the space **2*c* so that the margin portion 1A is moved close to the comb teeth 24**. FIG. 3(*c*) shows body 14 lowered to a point at which the margin portion of the towel 1A stops approximately in front of the comb tooth 24 when these teeth swing upward to the position in FIG. 3(*d*).

In FIG. 3(*d*), the pressing plate 34 is lowered over the towel cloth A against the resilience force of the coil springs 38 by the backward movement of the piston of the pneumatic cylinder 39 of the rear pressing unit 8 whereby the towel cloth A is pressed toward the surface of the working table 2*a*.

The segment gear 22 is rotated counterclockwise by the normal rotation of the drive motor 27 of the towel alignment unit 5 so that each comb tooth 24 is in an upper position whereby the comb teeth 24 contact with the lower surface of the towel cloth A. The towel cloth is pushed upward a short distance by teeth 24. At the same time, the pressing plate 34 moves downward and presses the cloth on the table 2*b*. The spring pressure is light enough to hold the cloth A on the working table yet is light enough to permit feeding of the towel cloth.

At the state in FIG. 3(*e*), at the state where the towel clost A is pressed by the pressing plate 34 of the rear pressing unit 8, each pneumatic cylinder 15 of each correction piece 16 is moved forward to draw each of the towel cloth A by each correction piece 16 so that each operative portion 24*a* of each comb tooth (Refer to FIG. 2) is engaged in each warp yarn of the margin portions 1A whereby the bent portion of the towel cloth A is corrected while the warp yarns of the margin portions 1A are aligned.

In FIG. 3(*e*), the correction pieces 16 by action of cylinders 15 move downward and draw the margin portion 1A toward the teeth 24, causing the points of teeth 24 to slip into the portion 1A. This permits operative portions 24 to align the border line of plain weave and margin portions 1A with the comb teeth.

At the state in FIG. 3(*f*), the L-shaped body 14 of the towel drawing unit 4 is placed in an upper position by reverse rotation of the drive motor 18 of the towel drawing unit 4 while each correction piece 16 is returned to an original position by the backward driving of each pneumatic cylinder 15.

The comb teeth 24 are placed in lower position by the reverse rotation of the drive motor 27 of the towel cloth alignment unit 5 to rotate the segment gear clockwise.

The pressing member 33 presses the surface of the towel cloth A while it is in a lower position by the forward movement of the piston rod of the pneumatic cylinder 32 of the front pressing unit 7.

That is, the towel cloth A is pressed by both the pressing member 33 and the pressing plate 34 and ready to be cut off by the towel cutting device 6.

At the state in FIG. 3(*g*), at the state of FIG. 3(*f*) the central portion of the margin portion 1A is cut off by the upper and lower cutters 28, 29 with the forward movement of the pistons of both the pneumatic cylinders 30, 31.

At the state of FIG. 3(*h*), both the movable and fixed metals 11, 10 release the clamping of the towel cloth A and the piece of cut towel material is delivered to a next step while the pistons of both the pneumatic cylinders 30, 31 of the cutting device 6 are backwardly moved to return the upper and lower cutters 28, 29 to their original positions. The piston of the pneumatic cylinder 32 of the front pressing unit 7 is moved backwardly while the piston of the pneumatic cylinder 39 of the rear pressing unit 8 is moved forwardly to release the clamping of the towel cloth A by both the pressing units 7, 8.

The series of the operations are successively repeated whereby the towel cloth A is cut off for preparing a plurality of towel materials.

With the arrangement of the cutting device of the towel cloth according to the present invention the following advantages are obtained.

In the case where a long sized towel cloth having the margin portions spaced in a predetermined interval is cut off to prepare a piece of towel material, a plurality of comb teeth are aligned with warp yarns of the margin portions for correcting bent portions of the towel cloth and avoid the warp yarns after completion of correction of bent portions so that the cutting operation can be made with ease without being hindered by the comb tooth.

Inasmuch as the upper and lower cutters are positioned at the center line of the width of each comb tooth when each comb tooth is actuated, the margin portion can be cut off substantially at the center line thereof. As a result, the length of each margin can be reduced to save the towel material.

Although the invention has been described in its preferred form with a certain degree of particularity, it is to be understood that many variations and changes are possible in the invention without departing from the scope thereof.

What is claimed is:

1. A cutting apparatus for severing the individual margin portions composed of warp yarns from a towel cloth having an end and plurality of said margin portions longitudinally disposed and spaced apart, said apparatus comprising:

a towel automatic sewing machine body;

first and second working tables disposed at the body in opposed positions, the tables having a space therebetween;

a clamping unit mounted on the first table for detachably clamping the end of the towel;

a towel drawing unit mounted on the first table for drawing a length of towel from the cloth;

a towel alignment unit for receiving the drawn length, mounted on the second table and rotatably secured to the body, the alignment unit including a segment gear secured to the end thereof, comb teeth supporting shaft secured to the gear and extending transversely across the towel cloth length, the shaft supporting a plurality of comb teeth disposed side by side in spaced position along the shaft and each comb tooth having an operative portion, a base and an operative portion defining an L shape, a pinion gear engaging the segment gear and rotatable in one direction to cause the comb teeth to engage the warp yarn of the margin portion of the drawn length and in an opposite direction to disengage the comb teeth from the yarn, and a motor for rotating the pinion gear in either direction; and a cutting device cooperating with the alignment unit for cutting the margin portion out of the drawn length.

2. The aparatus of claim 1 wherein the segment gear is adapted to be rotated back and forth by the pinion gear through an angle of 90 degrees.

3. The aparatus of claim 1 further including a front pressing unit and a rear pressing unit, both pressing units being adapted to press the cloth at the time the cutting device produces a cutting action, the front pressing unit pressing a front of a severed margin, the rear pressing unit pressing a rear of a severed margin.

* * * * *